United States Patent [19]

Koba

[11] Patent Number: 4,796,680

[45] Date of Patent: Jan. 10, 1989

[54] APPARATUS FOR TENDERIZING VENEER SHEETS

[75] Inventor: Yoshinori Koba, Tokaishi, Japan

[73] Assignee: Meinan Machinery Works, Inc., Japan

[21] Appl. No.: 36,004

[22] Filed: Apr. 8, 1987

[30] Foreign Application Priority Data

Apr. 10, 1986 [JP] Japan ..... 61-82492

[51] Int. Cl.[4] ..... B27M 1/02; B27M 3/00

[52] U.S. Cl. ..... 144/2 R; 29/121.6; 100/121; 144/362

[58] Field of Search ..... 100/121; 29/121.6; 144/2 R, 209 R, 213, 215, 361, 362, 2.5

[56] References Cited

U.S. PATENT DOCUMENTS

| | | | |
|---|---|---|---|
| 609,114 | 8/1898 | Munday | 144/173 |
| 3,674,219 | 7/1972 | Harvey, Jr. | 144/2 R |
| 3,718,959 | 3/1973 | Sailas | 29/121.6 |
| 3,969,802 | 7/1976 | Bouvet | 100/121 |
| 4,558,725 | 12/1985 | Veneziale | 144/362 |
| 4,655,869 | 4/1987 | Tellman et al. | 144/2.5 |
| 4,691,629 | 9/1987 | Koba | 144/362 |
| 4,718,338 | 1/1988 | Koba | 144/362 |

*Primary Examiner*—W. Donald Bray
*Attorney, Agent, or Firm*—Lahive & Cockfield

[57] ABSTRACT

Apparatus for tenderizing veneer sheets which comprises a pair of rotatable press means each having, on their surfaces, a plurality of projections having tops for pressing a veneer sheet to be tenderized. The projection tops of one of the press means and those of the other press means intersect each other at certain angles when opposed to each other during rotation thereof, and press against the veneer sheet from opposite sides when the sheet is passed between the press means, so as to produce small cracks in the sheet.

12 Claims, 6 Drawing Sheets

APPARATUS FOR TENDERIZING VENEER SHEETS

BACKGROUND OF THE INVENTION

This invention relates to apparatus for tenderizing vaneer sheets.

The conventional apparatus for tenderizing veneer sheets may be divided into the following three main categories:

(a) apparatus including a pair of rotatable rolls covered, at their circumferences, with elastic material such as rubber which deforms when a veneer sheet is passed between the rolls, and between which the sheet is subjected to a tensile force so that small cracks are produced in the sheet;

(b) apparatus including a roll with a small radius of curvature against which a veneer sheet is pressed to be bent so that small cracks are produced therein; and (c) apparatus including a number of cutters with which to cut a veneer sheet.

The foregoing apparatus (a) has the drawbacks that, since such an apparatus gives a tensile force to the sheet merely by producing friction between the sheet and the rolls, the portion of the sheet having a high mechanical strength may not be cracked, but the weak portion thereof may be excessively cracked, and that no cracks may be produced on the sheet if it is so orientated, when processed, that its fibers run at appreciable angles to the directions of the tensile force. Also, the foregoing apparatus (b) has the disadvantages that it can produce no cracks in veneer sheets with small thicknesses and that it cannot produce a sufficient number of cracks if the sheet is so orientated that its fibers run at appreciable angles to the direction of axis of the roll. With the foregoing apparatus (c), cuts or cracks may be made in the sheet irrespective of the fiber directions thereof, but it may cut the fibers crosswise and thus reduce the sheet strength, and it requires keeping the cutting tools sharp at all times.

Japanese Published Unexamined Utility Model Application No. 48-102274 discloses an apparatus for preventing a veneer sheet from being deformed to the shape of waves or eliminating such a deformation of the sheet. The apparatus includes a pair of rubber rolls each having, on their circumferences, a plurality of oblique grooves intersecting obliquely those of the other roll when the rolls contact each other. In this apparatus, the oblique projections on the rolls are pressed against the upper and lower surfaces of the sheet, and are elastically deformed, on these surfaces, in opposite directions, so that the sheet is subjected to a tensile force and is moderately deformed. This prior apparatus has the same disadvantage as the foregoing apparatus (a) in that the sheet may be cracked differently at its portions with different mechanical strengths. Also, this prior apparatus has the drawback that the tensile force it produces is not sufficient to produce cracks in a veneer sheet if the angle of the sheet fibers to the direction of the tensile force exceeds a certain limit.

SUMMARY OF THE INVENTION

The primary object of the invention is to provide apparatus for tenderizing veneer sheets with no disadvantages of the conventional apparatus as described above.

Other objects of the invention will become apparent during the following discussion of the accompanying drawing.

DETAILED DESCRIPTION OF THE PREFERRED EMBODIMENTS

Figure 1:
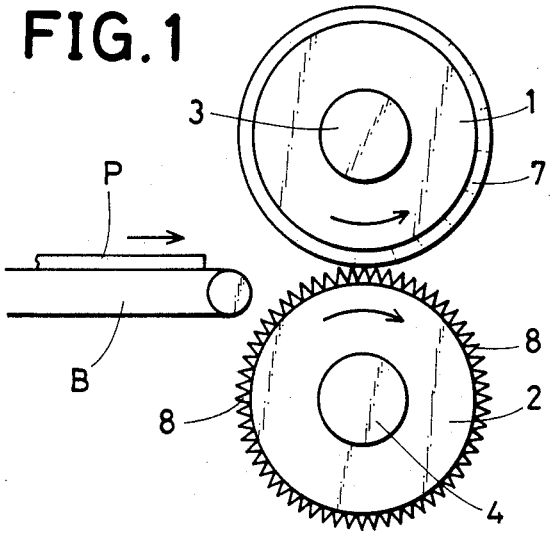
FIG. 1 is a side view of a pair of rotatable rolls as a preferred embodiment of the invention.
Figure 2:
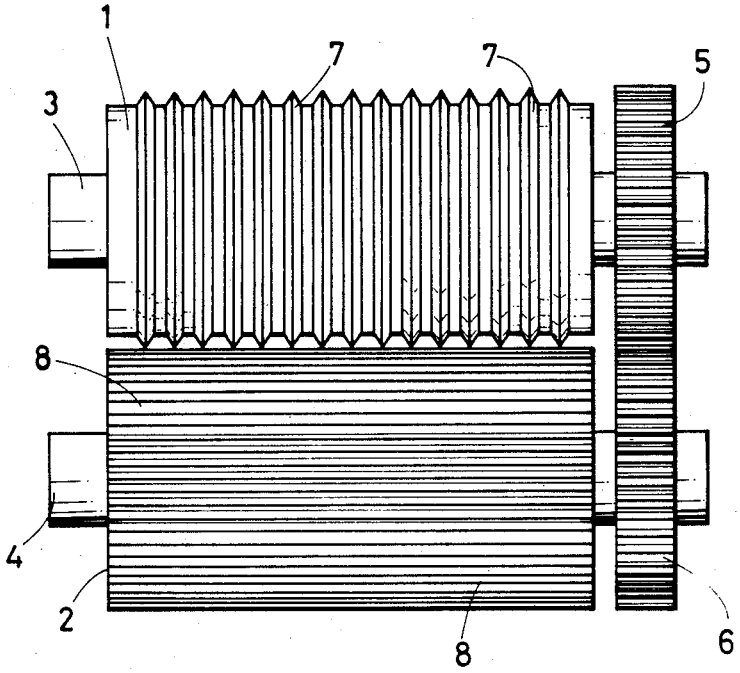
FIG. 2 is a front view of the rolls of FIG. 1.

Referring now to the drawings, and to FIGS. 1 and 2 in particular, there is shown a tenderizer according to a preferred embodiment of the invention which includes a pair of rotatable rolls 1 and 2, each illustratively having a diameter of 75 mm, and each provided with a plurality of radially-projecting angular projections 7 (for the roll 1) or 8 (for the roll 2) at its circumference. The two rolls 1 and 2 have central shafts 3 and 4, respectively, with parallel axes of rotation, and are adapted to be rotated at the same speed, in directions of arrows shown in FIG. 1, by means of associated gears 5 and 6 connected around respective one end portions of the central shafts 3 and 4. Each projection 7 of the upper roll 1 extends continuously around the circumference of the roll 1 and thus has a circular shape. The projections 7 are axially arranged side by side at regular intervals as well as at regular pitches, illustratively of approximately 5 mm. Each projection 8 of the lower roll 2 extends axially from one end of the roll 2 to the other end thereof, and the projections 8 are circumferentially arranged side by side at regular pitches, illustratively of approximately 3.6 mm, without being spaced apart from one another. Each projection 7 and 8 is tapered outward to have the shape of an isosceles triangle, in its cross section perpendicular to the circumference of the roll, which is 40 degrees in vertical angle and 5 mm in height. Thus, each projection has an edged top. It will be appreciated that the upper projections 7 and the lower projections 8, when opposite to each other, extend substantially at right angles relative to each other. Each projection is formed of suitable rigid material such as iron, steel (including stainless steel), rigid plastic, ceramic, or the like.

In FIG. 1, the letter B indicates a conveyor on which is placed a veneer sheet P to be moved thereby to be tenderized between the rolls 1 and 2. The upper and lower rolls 1 and 2 are so located relative to each other that the distance between the tops (edges) of the projections 7 and 8 is smaller than the thickness of the veneer sheet P, where the sheet P is to be tenderized between the rolls 1 and 2. Preferably this distance is set at 0 to 40% of the thickness of the sheet P.

Also, the foregoing elements B, 1 and 2 mount the pair of rolls for receiving the veneer sheet P from the conveyor B with the veneer sheet fibers oriented to extend along directions either substantially parallel or substantially perpendicular to the directions of the axes of the rotation of the rolls.

Figure 3:
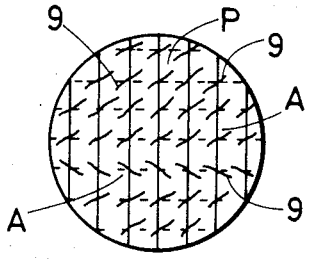
FIG. 3 is an enlarged view of a portion of a veneer sheet tenderized by being passed between the rolls of FIGS. 1 and 2.

In use, a veneer sheet P to be tenderized is so placed on the conveyor B that the fibers of the sheet P are directed, for example, substantially parallel to the directions of the axes of the rotation of the rolls 1 and 2. The conveyor B is operated to move the sheet P between the rotatable rolls 1 and 2, and the projections 7 and 8, with the edged tops thereof, press against the upper and lower surfaces, respectively, of the veneer sheet P to tenderize it as the sheet P is passed therebetween. Since, as is seen from the foregoing description, the pressing edges of the projections 7 of the upper roll 1 and those of the projections 8 of the lower roll 2 are located transversely, e.g. at right angles to each other where they press against the sheet P, the sheet P is pressed as shown in FIG. 3. That is, the sheet is pressed, at its upper surface, as shown by solid lines, while it is pressed, at its lower surface, as shown by dotted lines which are transverse to the solid lines. Thus, the sheet is deformed, or depressed, especially where the pressed portions indicated by the solid lines intersect those indicated by the dotted lines. Each portion of intersection and its vicinity are collectively designated by the letter A in FIG. 1.

This action of the rolls 1 and 2, with the projections 7 and 8 thereon, produces a tensile force among the portions A, and the most weak portions of the veneer sheet P subjected to the tensile force, that is, the portions along the directions of the fibers, are cracked in part and across each portion A, as indicated by numeral 9 (FIG. 3). Thus the entire sheet P is texturized.

The veneer sheet P is thus tenderized. It will be appreciated that even a veneer sheet having fibers oriented in various directions can be adequately tenderized by using the foregoing apparatus.

Also, as is clear from the above description, the possibility of the foregoing apparatus cutting the sheet across its fibers is very small compared with that of the conventional tenderizing apparatus which uses cutters. Thus, according to the invention, the mechanical strength of the sheet is not substantially reduced due to the tenderizing operation. In addition, needless to say, one operation as required in the foregoing prior art, i.e., keeping cutters sharp, is no longer needed. Moreover, the foregoing apparatus presses a veneer sheet densely with its simple construction, i.e., its projections 7 and 8 perpendicular to each other with the sheet between. The apparatus of the invention therefore enables a veneer sheet to be manufactured at a lower cost than the prior tenderizer which presses a veneer sheet with needle-shape projections.

If desired, the veneer sheet P may be so placed on the conveyor that its fibers run along directions substantially perpendicular to the directions of the axes of the rotation of the rolls 1 and 2. However, as far as the above-mentioned apparatus is concerned, the sheet will elongate more, during tenderizing operation, if its fibers are substantially parallel to the directions of the axes of the rotation of the rolls than if they are oriented in the foregoing substantially perpendicular directions.

Figure 4:
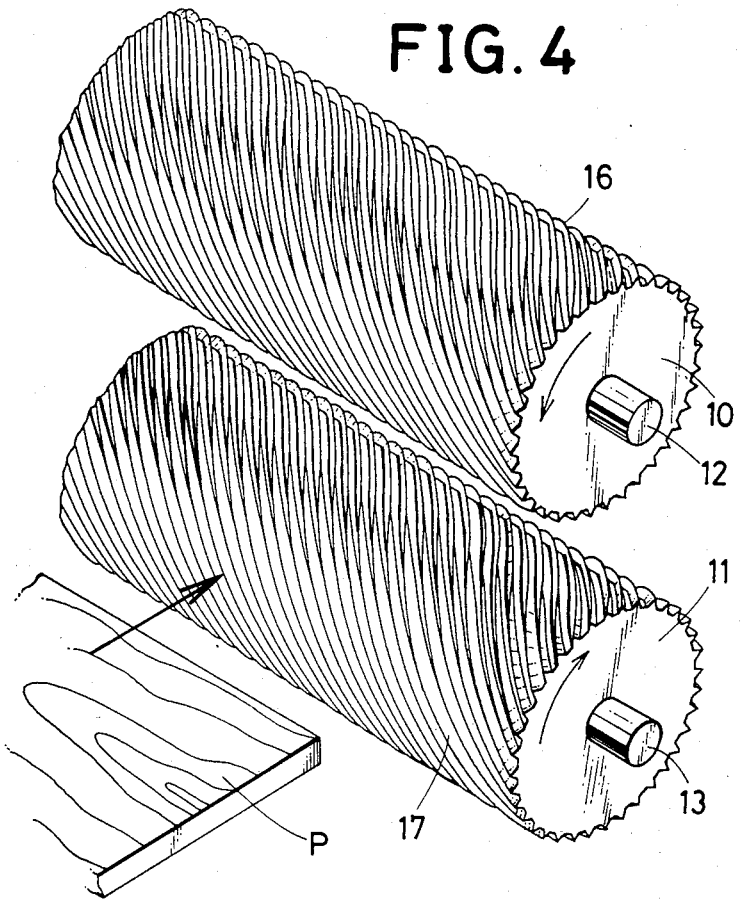
FIG. 4 is a perspective view of a pair of rotatable rolls as another preferred embodiment of the invention.

Another embodiment of the invention may be obtained by using rotatable rolls 16 and 17 of FIG. 4 instead of those of FIGS. 1 and 2. The rotatable rolls 16 and 17 have parallel axes of rotation, and are provided, at their respective circumferences, with angular projections 16 and 17 which have vertical cross sections similar to those of the projections 7 and 8 of FIGS. 1 and 2, and thus have edged tops, but are arranged spirally, side by side, at regular intervals and at regular pitches (for example, of 4 mm). The spiral projections 16 and 17 form, with the axial directions of their respective central shafts 12 and 13, a certain angle selected from among a range of 15 to 60 degrees, and extend in the same direction. As with the preceding projections 7 and 8, the projections 16 and 17 are so oriented relative to each other that their edged tops intersect each other where they press against a veneer sheet P. However, the angle of intersection of the tops of the projections 16 with the tops of the projections 17 is different from that between the tops of the preceding projections 7 and 8. A veneer sheet P to be tenderized is thus pressed and cracked, as, for example, shown in FIG. 5 wherein solid lines indicate the pressing of the sheet by the upper projection tops and dotted lines indicate the pressing thereof by the lower projection tops and numeral 18 designates the cracks. The rolls 10 and 11, with the spiral projections 16 and 17, may be manufactured more easily at a lower cost than the preceding rolls 1 and 2.

Figure 5:
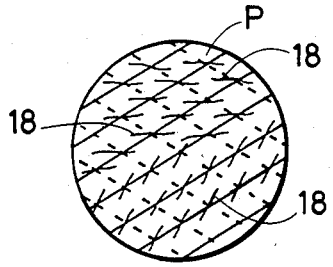
FIG. 5 is an enlarged view of a portion of a veneer sheet tenderized by being passed between the rolls of FIG. 4.
Figure 6:
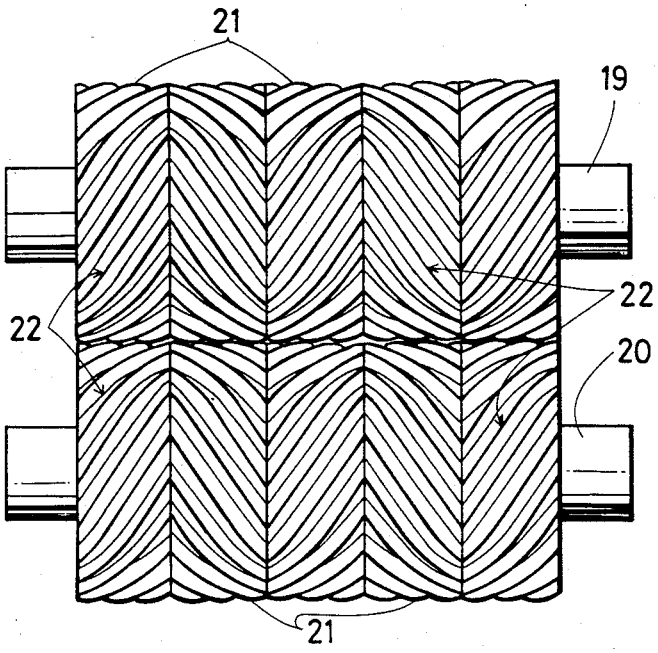
FIGS. 6 to 8 show other preferred embodiments of the invention.

The rotatable rolls as shown in FIGS. 1 and 2 and in FIG. 4 are integral with their respective central shafts 3,4 and 12,13. For the apparatus according to one alternative practice of the invention, however, a plurality of annular rolls with small widths may be removably connected to a rotatable central shaft. One example of such a construction is shown in FIG. 6. In FIG. 6, a plurality of annular rolls 21 each, illustratively having a thickness of approximately 40 mm and a diameter of approximately 295 mm, is each provided with a number of spiral, angular projections 22 at its circumference. The rolls 21 are removably mounted, side by side with aligned axis of rotation, around a central rotatable shaft 19 or 20 by using key means and keyways. The central rotatable shafts 19 and 20 have parallel axes of rotation. The spiral, angular projections 22 of each roll 21 have a vertical cross section similar to those of the preceding projections 16 and 17, and thus are edged at their tops, and, as with the projections 16 and 17, are located at regular intervals as well as at regular pitches. Either of the upper and lower rotatable rolls 21 collectively provides a means similar to any one of the preceding single rolls not only in its general shape, but in its function. However, the construction of the FIG. 6 roll 21 is sharply distinguished from that of the roll 16 or 17 of FIG. 4. The upper spiral projections 22 in FIG. 6 run in the same direction as the corresponding lower ones 22, but each pair of corresponding upper and lower spiral projections 22,22 runs in a different direction from the adjacent pair or pairs, so that the spiral projections 22, as a whole, run in zigzags. Thus, in the illustrated embodiment of FIG. 6, a veneer sheet is pressed as shown in FIG. 5 at its portions passing between the second and fourth rolls from the rightmost ones, but is pressed at its portions passing between the other rolls in such a manner that the solid lines of FIG. 5 change places with the dotted lines thereof.

Such a configuration of spiral projections as in the apparatus of FIG. 6 enables the tenderizing of veneer sheets without a drawback of the construction of FIG. 4, in that veneer sheets of certain materials may tend to curve in the direction perpendicular to the spiral projections 16 and 17 (FIG. 4) while they are being pressed. The apparatus of FIG. 6 avoids this advantage because the zigzag arrangement of the spiral projections in FIG. 6 may cancel the forces which otherwise tend to curve the veneer sheet in the different directions.

Also, the construction of FIG. 6 has an economical advantage that, if any one of the rolls 21 is damaged due to, for example, foreign objects, the whole apparatus can be repaired by replacing only the damaged roll. Moreover, the relative locations of the rolls 21 may be changed to provide a construction suitable for the tenderizing of a particular veneer sheet, or any one of the rolls 21 may be replaced with another annular roll for the same purpose.

Figure 7:
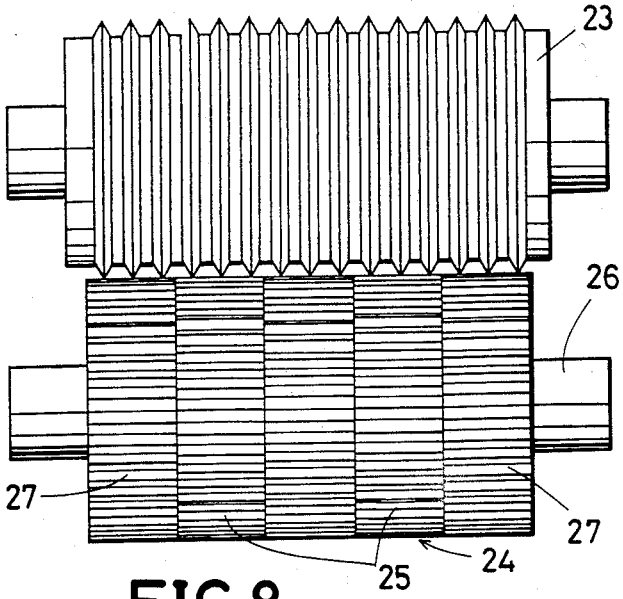
Figure 8:
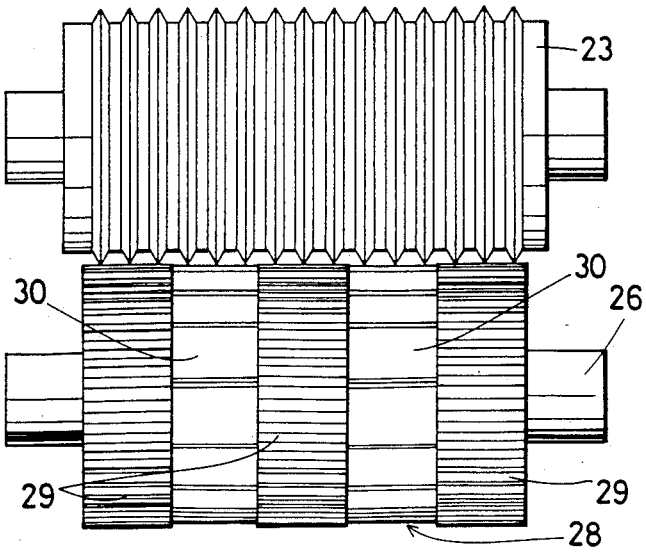
Figure 9:
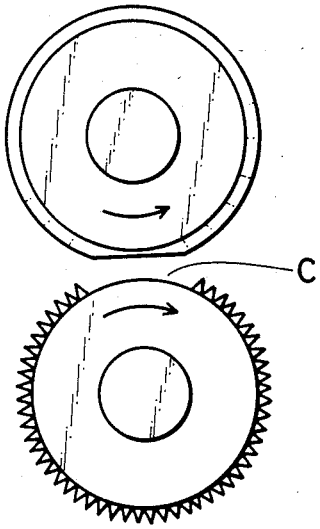
FIG. 9 shows a partial omission of projections on a rotatable roll.

Another embodiment of the invention may be obtained by using the same upper roll as the roll 1 of FIG. 2 and a plurality of removable annular lower rolls, as shown in FIG. 7 or 8. In the illustrated construction of FIG. 7, an upper rotatable roll 23 having the same construction as the roll 1 of FIG. 2 is used in combination with a plurality of annular lower rolls 25, which are removably mounted, side by side, around a central rotatable shaft 26. The upper roll 23 and the lower rolls 25 have parallel axes of rotation. Each roll 25 is provided with a number of angular projections 27 extending axially, on its circumference, from one end to the other end thereof. Each angular projection 27 of each lower roll 25 has a vertical cross section similar to that of each projection of the upper roll 23, and thus has an edged top. The projections 27 of each lower roll 25 are located at regular pitches, along the direction of rotation thereof, i.e., about the circumference, without being spaced apart from one another. The projections 27 hence are arranged circumferentially in the same manner as the projections 8 of the roll 2 of FIG. 2. The foregoing pitches are the same for all projections 27 of the lower rolls 25. As illustrated, however, each lower roll 25 is so mounted that the edged tops of its projections 27 are arranged at one half of the foregoing pitch relative to those of the projections of the adjacent lower roll or rolls 25. Thus, the edged top of each projection of each roll 25 is in alignment not with that of the adjacent roll or rolls 25, but with that of next roll but one, i.e., the rolls 25,25 are in an alternating arrangement relative to the tops of the projections 27 on each.

In use, a veneer sheet to be tenderized is so orientated that its fibers run in directions substantially perpendicular to the direction of conveyance thereof between the rotatable rolls 23 and 25, and is conveyed between them so that the sheet is partly cracked in a manner similar to that in the case of the construction of FIG. 2. However, the construction of FIG. 7 is different from that of FIG. 2 in the following respect. In the construction of FIG. 2, if the directions of the fibers of a veneer sheet conveyed between the rolls 1 and 2 happen to be exactly or almost exactly parallel to those of the lower projections 8, the cracks of the sheet brought about by the upper and lower projections 7 and 8 may be more or less continuously aligned with one another along the lower projections 8. This considerably reduces the mechanical strength of the sheet in the directions perpendicular to its fibers. On the other hand, in the construction of FIG. 7, if a veneer sheet is conveyed between the rolls 23 and 25 with the fibers in a similar orientation, the cracks of the sheet brought about by the upper and lower projections are only intermittently aligned with one another along the lower projections 27, because the lower projections 27 are only intermittently aligned with one another in the axial direction of the lower rolls 25. Therefore, a veneer sheet may be tenderized with less reduction of its mechanical strength by using the construction of FIG. 7 than by using that of FIG. 2.

The construction of FIG. 7 may be modified by replacing its removable and rotatable, annular lower rolls 25 with rolls 29 and 30 of FIG. 8. In FIG. 8, the removable annular lower rolls 29 and 30 are arranged alternately along and around a central rotatable shaft 26. The rolls 29 are provided with angular projections having the same shape and located in the same manner as those 27 of FIG. 7, while the other rolls 30 are provided with angular projections which have edged tops and axially extend like those of the rolls 29, but are circumferentially spaced apart from one another. The intervals of distance between the projections of each roll 30 are regular, and rather long so that the projections of each roll 30 are rather smaller in number than those of each roll 29. Also, each projection of each roll 30 has a rather smaller width than that of the roll 29. When a veneer sheet is passed between the upper roll 23 and the lower roll 28 which designates the lower rolls 29 and 30 collectively, the portions of the sheet pressed by the upper roll 23 and by the lower rolls 29 are cracked as, for example, shown in FIG. 3, so that these portions elongate or stretch. At the same time, the portions of the sheet pressed by the upper roll 23 and by the lower rolls 30 are deformed where the projections on these rolls intersect each other, and a tensile force is produced between the elongated portions and the deformed sections, so that the portions of the sheet pressed by the rolls 23 and 30 are also cracked. In short, when using the construction of FIG. 8, a number of cracks may be produced with a relatively small pressure.

Veneer sheets of certain materials may elongate differently at different portions when cracked during the tenderizing operation, and it is possible that a portion of such a veneer sheet which has elongated only to a slight degree may brake the entire sheet coming from between the rolls and thus the entire sheet may turn aside and drop from the conveyance line. This may be prevented by omitting some of the projections from the upper and/or lower roll. An example of such a partial omission of the projections is illustrated in FIG. 6 where some of the projections are omitted from the circumferences of both upper roll and lower roll, as indicated by the letter C. When using such a construction, the veneer sheet will have one portion with no cracks every time the rolls have made one rotation and, thus, if a portion of the sheet elongates differently from others when cracked, such a portion may automatically and elastically resume its normal shape, owing to the presence of the not-cracked portions adjacent thereto. Therefore, a number of veneer sheets may be continuously processed without the interruption which would occur if even one of them dropped from the conveyance line.

In each of the foregoing embodiments of the invention, the central shafts of the upper roll (or roll means) and of the lower roll (or roll means) are supported by a frame structure (not shown) which mounts the two central shafts so that the tops of the projections of the upper roll (or roll means) and the tops of the projections of the lower roll (or roll means) have a distance between them which is smaller than the thickness of the veneer sheet when the projections of the two rolls are opposite each other during the rotation of the rolls.

Figure 10:
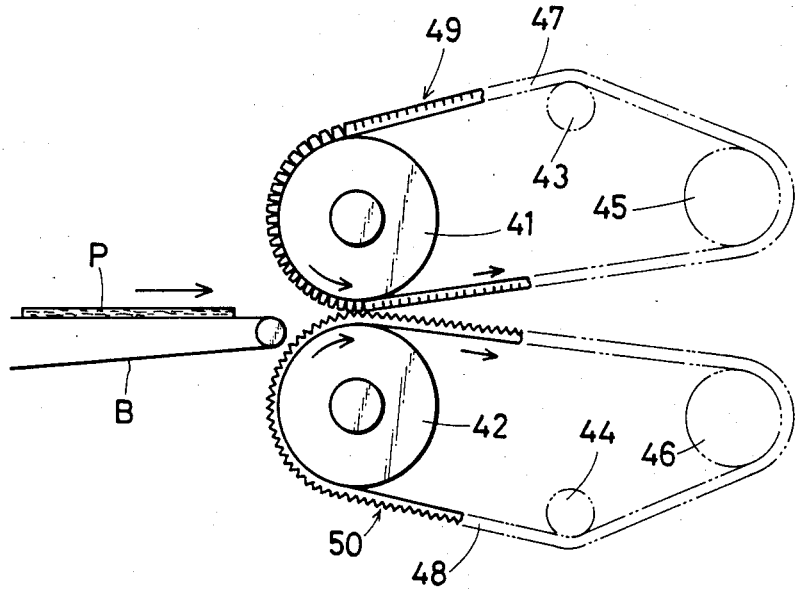
FIG. 10 shows still another embodiment of the invention.

FIG. 10 illustrates still another tenderizing apparatus according to the invention which comprises a pair of upper and lower pressing constructions. The upper pressing construction includes three deflecting rollers 41, 43 and 45. The lower pressing construction also includes three deflecting rollers 42, 44 and 46. Steel belts 47 and 48 pass around the upper and lower combinations of deflecting rollers, respectively. The upper and lower rollers 41 and 42 may be rotated by a drive means (not shown). Projections 49 similar to the projections 7 of FIG. 2 are formed on the upper steel belt 47 along the direction of rotation of the roller 41, while projections 50 similar to the projections 8 of FIG. 2 are formed on the lower steel belt 48 along the axis of the roller 42. Unlike the projections 7 of FIG. 2, however, each projection 49 of the upper belt 47 is notched at regular intervals along the direction of rotation of the roller 41 so that it may rotate along the rollers 41, 43 and 45. The upper and lower projections 49 and 50 press against a veneer sheet P to tenderize it when the sheet P is passed between the rollers 41 and 42. Although, in either of the upper and lower pressing constructions, each roller has an appreciably different diameter from the other rollers, such an embodiment as shown in FIG. 10 may also be possible with, for example, the roller 41 or 42 and the roller 45 or 46 having the same diameter. However, it will be appreciated that such ratios of the diameters of the rollers as illustrated in FIG. 10 may be selected to manufacture the tenderizing apparatus at a lower cost.

Figure 11:
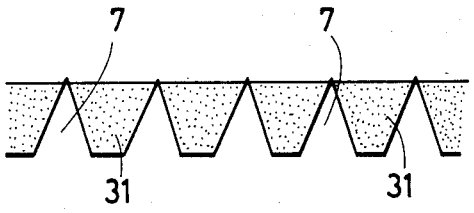
FIG. 11 shows a method of removing foreign objects from between projections on a rotatable roll in accordance with a further feature of the invention.

In any one of the foregoing tenderizing apparatus, veneer chips or decomposed veneer portions may be caught between the projections, during the tenderizing operation, so that the projections cannot effectively press the veneer sheets unless such foreigh objects are removed. This problem may be solved, however, by a method illustrated with reference to FIG. 11. According to this method, an elastic material 31 such as crude or urethane rubber is applied to a pair of rolls to fill the spaces between the projections, in advance, to the level lower than, but very close to, the level of the tops of the projections. If debris such as veneer chips presses against the elastic material 31 and between the projections, the material 31 is compressed to a certain degree, but finally resists the force of the chips and returns to its original shape to push them out.

An important aspect of the invention resides in pressing veneer sheets with upper and lower projections of rigid material which intersect each other with veneer sheets between. As used herein, the projections intersect in the sense that the projections are located along paths or imaginary lines on an upper roller which cross and hence intersect the projection paths on a lower roller, when the rollers are viewed from above or from below. Although the projections have been described as tapering outward to provide edged tops, it is not necessarily required that the projections have "edges" in order to press and thereby tenderize the sheets, but the projections may be so formed as to have certain flat tops to press, or tenderize, the sheets. This means that, when the edged tops of the projections have become more or less flat due to use, they may still press the sheets effectively, as long as the flatness thereof does not exceed a certain limit. Also, the invention can be practiced with numerous kinds of rigid material for the projections, and with different numbers thereof, and the like, as those skilled in the art may select in view of this disclosure. Moreover, it will be appreciated that an upper or lower projection does not necessarily extend continuously. It is sufficient if the projections intersect each other, with veneer sheets between, at sufficient points to attain the desired level of tenderization. Furthermore, for the construction of FIG. 10, both the axial lengths of the rollers and the widths of the steel belts, as well as the diameters of the rollers, may be selected in accordance with the dimensions and kind of wood of veneer sheets.

As mentioned before, the projections 7 (FIG. 2), 16 and 17 (FIG. 4) and 22 (FIG. 6) are spaced apart from one another. However, it is not a requirement for the invention, and, if desired, these projections may be continuous like the other projections. That is to say, it is sufficient if the projections are arranged at pitches which yield adequate tenderization of veneer sheets.

The projections of any foregoing tenderizing apparatus may wear down first at intersections with other projections than elsewhere, and when the intersecting locations can no longer produce the desired cracks, the upper and lower rolls may be so relocated relative to each other that their projections intersect at different locations to perform again the desired functions.

There is a case where continuous adhesive paper tapes of small width are attached to both upper and lower surfaces of a veneer sheet at its opposite end portions perpendicular to the direction of the veneer fibers, before the sheet is passed between the pressing rolls, so that the mechanical strength of the sheet is not reduced, in its directions perpendicular to the fibers, during tenderizing operation. However, in such a case, the foregoing end portions of the sheet hardly elongate during tenderization because the tapes attached thereto hold the end portions together, although other portions of the sheet are not prevented from elongating. Thus, the whole sheet is curved.

The foregoing problem may be solved by providing the pressing rolls, at the locations corresponding to the tapes on the sheet and at regular intervals (for example, of 5 mm), with cutters which form selected angles with the rolls and which cut into the tapes and the sheet surface to a required depth. Thus, the tapes on the sheet are cut obliquely, as the sheet is passed between the pressing rolls, so that the end portions of the sheet, on which the tapes are attached, are allowed to elongate like the other portions of the sheet, while at the same time the whole sheet is protected against reduction of its mechanical strength in the directions perpendicular to the fibers because the tapes are not cut parallel with the sheet fibers. It will be appreciated that spiral projections such as the projections 16 and 17 of FIG. 4 perform the same function as the foregoing cutters.

It is to be understood that the present invention makes it possible to tenderize well, with a simple construction, a veneer sheet which has fibers extending along various directions and which, hence, could not be processed by the conventional tenderizing apparatus.

Other variations of the invention will be apparent to those skilled in the art. Accordingly, the invention is not to be considered to be limited to the specific embodiments shown and described herein, but only as set forth by the appended claims.

What is claimed is:

1. An apparatus for tenderizing veneer sheets, comprising (a) a pair of first and second rotatable press means each having a circumference with a plurality of radial projections extending in predetermined directions, (b) said projections of each said press means being formed of substantially rigid material, (c) each said projection of each said press means having a top for pressing against a veneer sheet to be tenderized, (d) said first and second press means being so located relative to each other that the tops of the projections of the first press means and the tops of the projections of the second press means are separated by less than the thickness of the veneer sheet when the projections of the two press means are opposed to each other during rotation thereof, (e) means mounting the two press means for passing the veneer sheet between the press means, for tenderization, with such an orientation that the fibers thereof extend along directions predetermined relative to the directions of axes of rotation of the two press means, and (f) the tops of the projections of the first press means and the tops of the projections of the second press means defining respective first and second elongate regions, said regions intersecting each other transversely to form localized intersection regions of sufficiently high compression between opposed projections pressing against the veneer sheet from opposite sides as the sheet is passed therebetween, to produce small cracks in the sheet localized at said intersection regions.

2. Apparatus in accordance with claim 1, wherein the first press means comprises a first roll structure having said circumference with said plurality of radial projections and the second press means comprises a second roll structure having said circumference with said plurality of radial projections, said first and second roll structures having parallel axes of rotation.

3. Apparatus in accordance with claim 2, wherein (a) the projections of the first roll structure extend, side by side, along the direction of rotation thereof and are arranged at regular pitches along the direction of the axis of rotation thereof, and (b) the projections of the second roll structure extend, side by side, along the direction of the axis of rotation thereof and are arranged at regular pitches along the direction of rotation thereof.

4. Apparatus in accordance with claim 3, wherein the projections of the first roll structure are located along a selected length thereof, and the projections of the second roll structure extend along at least said selected length.

5. Apparatus for tenderizing veneer sheets in accordance with claim 15, wherein (a) the first roll structure is a single continuous structure formed integrally with a central rotatable shaft, (b) the second roll structure comprises a plurality of rolls having aligned axes of rotation and removably mounted, side by side, on a central rotatable shaft, and (c) each said roll of the second roll structure is provided, on the circumference thereof, with a plurality of radial projections which extend axially, side by side, from one end to the other end of the roll and are arranged at regular pitches along the direction of rotation thereof.

6. Apparatus in accordance with claim 5, wherein the projections of each said roll of the second roll structure are arranged at regular pitches, along the direction of rotation of the roll, which are the same for all the projections of the rolls, and each said roll is so mounted that the tops of its projections are arranged at one half of the foregoing pitch relative to the tops of the projections of the adjacent roll, and thus the top of each projection of each said roll is in alignment not with the top of any projection of the adjacent roll, but with the top of one of the projections of next roll but one.

7. Apparatus in accordance with claim 5, wherein the pitches of the projections of first ones of said rolls of the second roll structure are greater than the pitches of the other, second ones of said rolls and thus the projections of the first rolls are smaller in number than the projections of the section rolls, and wherein the projections of the first rolls are smaller in width than the projections of the second rolls, the first rolls and the second rolls being located in alternate circumferential positions.

8. Apparatus in accordance with claim 2, wherein the projections of each said roll structure extend spirally.

9. Apparatus in accordance with claim 8, wherein (a) each said roll structure is a single continuous structure integrally formed with a central rotatable shaft, (b) the projections of each said roll structure extend spirally, side by side, around the circumference thereof and are arranged at regular pitches along the direction of rotation thereof, and (c) the projections of the two roll structures extend in the same direction.

10. Apparatus in accordance with claim 8, wherein (a) each said roll structure comprises a plurality of rolls having aligned axes of rotation and removably mounted, side by side, on a central rotatable shaft, (b) each said roll of each said roll structure is provided with a plurality of projections running spirally, side by side, around the circumference thereof and arranged at regular pitches along the direction of rotation thereof, and (c) the projections of each said roll of each roll structure run in the same direction as those of a corresponding roll of the other roll structure, and the projections of adjacent ones of the rolls of each said roll structure run in different directions, so that the projections of the rolls of each said roll structure, as a whole, run in zigzags.

11. Apparatus for tenderizing veneer sheets in accordance with claim 1, wherein (a) each said press means comprises a plurality of deflecting rollers and a belt means passing around said deflecting rollers and adapted to be driven thereby.

(b) said belt means of said first press means is provided, on a circumference thereof, with a plurality of radial projections which extend, side by side, along the direction of rotation of said rollers of the first press means and are arranged at regular pitches along the axes of the rollers, each of said projections being radially notched along the direction of rotation of the rollers, and (c) said belt means of said second press means is provided, on a circumference thereof, with a plurality of radial projections which extend, side by side, along the axes of said rollers of the second press means and are arranged at regular pitches along the direction of rotation of the rollers.

12. Apparatus in accordance with any one of claims 1 or 2–11, wherein each said projection is tapered outward so that the top thereof is an edged top.

* * * * *

UNITED STATES PATENT AND TRADEMARK OFFICE

CERTIFICATE OF CORRECTION

PATENT NO. : 4,796,680

DATED : 10 January 1989

INVENTOR(S) : Yoshinori Koba

It is certified that error appears in the above-identified patent and that said Letters Patent is hereby corrected as shown below:

Column 9, line 49, replace "claim 15" with --claim 4--.

Signed and Sealed this

Third Day of April, 1990

*Attest:*

HARRY F. MANBECK, JR.

*Attesting Officer*

*Commissioner of Patents and Trademarks*